US006837751B2

(12) United States Patent
Vanden Wymelenberg et al.

(10) Patent No.: US 6,837,751 B2
(45) Date of Patent: Jan. 4, 2005

(54) ELECTRICAL CONNECTOR INCORPORATING TERMINALS HAVING ULTRASONICALLY WELDED WIRES

(75) Inventors: Mark J. Vanden Wymelenberg, Girard, OH (US); Shao C. Hsieh, Warren, OH (US); Edward M. Bungo, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/205,245

(22) Filed: Jul. 25, 2002

(65) Prior Publication Data

US 2004/0018777 A1 Jan. 29, 2004

(51) Int. Cl.[7] ..... H01R 13/502

(52) U.S. Cl. ..... 439/701; 439/874; 439/347; 439/634

(58) Field of Search ..... 439/874, 347, 439/489, 752, 701, 595, 352, 634

(56) References Cited

U.S. PATENT DOCUMENTS

| | | | | |
|---|---|---|---|---|
| 3,053,124 A | | 9/1962 | Balamuth et al. | 228/56 |
| 3,717,842 A | | 2/1973 | Douglas, Jr. | 29/860 |
| 3,822,465 A | | 7/1974 | Frankort et al. | 29/470.1 |
| 4,039,114 A | | 8/1977 | Yoshida et al. | 228/110 |
| 4,557,542 A | * | 12/1985 | Coller et al. | 439/752 |
| 4,867,370 A | | 9/1989 | Welter et al. | 228/110 |
| 5,031,821 A | | 7/1991 | Kaneda et al. | 228/110 |
| 5,281,168 A | * | 1/1994 | Krehbiel et al. | 439/752 |
| 5,423,474 A | | 6/1995 | Kanagawa et al. | 29/866 |
| 5,462,453 A | | 10/1995 | Muller | |
| 5,489,224 A | * | 2/1996 | Schwarz | 439/752 |
| 5,772,100 A | | 6/1998 | Patrikios | 228/1.1 |
| 5,775,930 A | | 7/1998 | Model et al. | |
| 5,857,259 A | | 1/1999 | Johnston | 439/404 |
| 5,957,735 A | | 9/1999 | Shinchi | 439/874 |
| 5,959,253 A | | 9/1999 | Shinchi | 439/874 |
| 6,007,371 A | * | 12/1999 | Hickox | 439/498 |
| 6,018,127 A | | 1/2000 | Shinchi et al. | 439/874 |
| 6,027,008 A | | 2/2000 | Toi et al. | 228/110 |
| 6,059,617 A | | 5/2000 | Shinchi | 439/874 |

(List continued on next page.)

FOREIGN PATENT DOCUMENTS

| | | | |
|---|---|---|---|
| EP | 286031 A2 | 10/1988 | |
| GB | 2325576 A * | 11/1998 | H01R/13/52 |

OTHER PUBLICATIONS

Generic Description of an Insulation Displacement Connection Dated Much Earlier Than Nov. 2000.

Ultraweld® 40 Fact Sheet of American Technology, Inc. of Milford Conn., Date Unknown, but Believed Dated at Least as Early as Nov. 2000.

"Ultrasonic Metal Welding for Wire Splicing and Termination" by Gary Flood, Pub. by American Technology, Inc of Milford, Conn. 15 pgs. dated unknown, but Belived as early as Nov. 2000.

*Primary Examiner*—Briggitte R. Hammond
(74) *Attorney, Agent, or Firm*—David P. Wood

(57) ABSTRACT

An electrical connector utilizing a plurality of terminals to which wires have been ultrasonically welded, most preferably via UWTI technology, wherein the terminals are aligned for the welding process and also aligned in the connector via one or more terminal carriers. Terminals are placed into respective seats in two terminal carriers, and wires are then ultrasonically welded to the terminals. The terminal carriers are then superposed and placed into a connector body of the electrical connector. The ultrasonic welding process is implemented by an anvil passing through an aperture in the terminal carriers at each terminal so that it is able to sonically and pressurably co-act with the tip of the ultrasonic welding apparatus to thereby effect an ultrasonic weld of the wire(s) to the respective terminals, preferably through the insulation thereof.

19 Claims, 6 Drawing Sheets

U.S. PATENT DOCUMENTS 6,071,153 A 6/2000 Fink et al.
6,099,364 A 8/2000 Shinchi ..... 439/874
6,099,366 A 8/2000 Shinchi ..... 439/874
6,142,813 A 11/2000 Cummings et al.
6,162,085 A 12/2000 Chugh et al.
6,168,445 B1 1/2001 Seutschniker et al.
6,171,146 B1 1/2001 Fink et al.
6,176,746 B1 1/2001 Morello et al.
6,179,658 B1 1/2001 Gunay et al.
6,203,364 B1 3/2001 Cupak et al.
6,210,186 B1 4/2001 Fink et al.
6,213,795 B1 4/2001 Drescher et al.
6,232,556 B1 5/2001 Daugherty et al. ..... 439/874
6,247,965 B1 6/2001 Cummings et al.
6,247,977 B1 * 6/2001 Tanaka et al. ..... 439/874
6,276,960 B1 8/2001 Schaefer et al.
6,305,957 B1 10/2001 Fink et al.
6,319,071 B1 * 11/2001 Sato ..... 439/701
6,334,251 B1 1/2002 Ide ..... 29/857
6,338,651 B1 1/2002 Svette, Jr. et al.
6,361,356 B1 3/2002 Heberlein et al.
6,379,162 B1 4/2002 Raypole et al.
6,383,033 B1 5/2002 Politsky et al.
6,406,307 B2 6/2002 Bungo et al.
6,409,525 B1 * 6/2002 Hoelscher et al. ..... 439/141
6,416,119 B1 7/2002 Gericke et al.
6,422,881 B1 7/2002 Puhl et al.
6,485,318 B1 11/2002 Schoepf
6,485,337 B2 11/2002 Hsieh
6,494,751 B1 12/2002 Morello et al.
6,508,666 B1 1/2003 Francis
6,527,573 B2 3/2003 Stein, Sr. et al.
6,533,611 B2 3/2003 Morello et al.
6,537,099 B2 3/2003 Herlinger et al.
6,547,605 B2 4/2003 Daugherty et al.
6,565,372 B2 5/2003 Bakker et al.
6,568,948 B2 * 5/2003 Matsuoka ..... 439/752
6,607,393 B2 8/2003 Raypole et al.

* cited by examiner

ELECTRICAL CONNECTOR INCORPORATING TERMINALS HAVING ULTRASONICALLY WELDED WIRES

TECHNICAL FIELD

The present invention relates to electrical connectors, and more particularly to an electrical connector having integrated terminal carriers, each terminal carrier carrying a plurality of terminals which have been ultrasonically welded to their respective wires through the insulation jackets thereof.

BACKGROUND OF THE INVENTION

Ultrasonic welders are known in the art, as exemplified by U.S. Pat. Nos. 5,772,100, 4,867,370 and 3,053,124. This class of devices utilizes ultrasonic energy to join metals, particularly nonferrous metals used in the electrical arts, as for example the splicing of wires and the attachment of a wire to a terminal. Ultrasonic welding is not actually "welding" in the sense that there is no application of heat as is used in conventional welding, wherein metals are heated to the point of melting into each other. In the case of ultrasonic welding, a mechanical vibration is applied to the metals, typically in the preferred frequencies of 20 kHz or 40 kHz.

The frequency and the amplitude of the vibration cause the metals to mutually gall at their contact surfaces. This galling results in contaminants, such as for example surface oxidation, to be displaced. The galling further causes the contact surfaces to be polished. As galling continues, the contact surfaces become intimate, whereupon atomic and molecular bonding occurs therebetween, thereby bonding the metals together with a weld-like efficacy (ergo, the term "ultrasonic welding").

A number of considerations determine the efficacy of the metal-to-metal surface bond, the major considerations being the amplitude of the vibration, the applied force and the time of application. These variables collectively define the efficacy of bonding between the contacting metal surfaces. The applied power (P) is defined by the amplitude (X) of vibration times the force (F) applied normal to the metal surfaces (P=FX), and the applied energy (E) is defined by the applied power (P) times the time (t) of application (E=Pt). These variables are predetermined to achieve the most efficacious bond based upon the metals and the particular application.

To provide reliable and predictable bonds by ultrasonic welding, ultrasonic welders include power supplies and actuators controlled by a microprocessor. An example thereof is the "Ultraweld® 40" ultrasonic welder of AMTECH® (American Technology, Inc.) of Milford, Conn. This class of commercially available ultrasonic welders include: a power supply, a transducer where electrical energy is converted into mechanical vibration, an amplitude booster where the mechanical vibrations are amplified, and an output tool in the form of a horn which tunes the vibrations to a tip. The tip is aligned with a stationary anvil, and the ultrasonic welder includes one or more actuators which allow for movement of the tip relative to the anvil. Preferably, the tip and the anvil are knurled so as to grip the metals placed therebetween.

In operation of a conventional ultrasonic welder, a wire is stripped of its insulation jacket at an end section, and the stripped end section is then placed adjacent a top surface of a base of a terminal to which it is to be bonded. The operator places the stripped section of wire and terminal into the ultrasonic welder, such that the a bottom surface of the base rests upon the anvil and the stripped section of the wire is aligned with the tip. The operator then causes the sonic welder to automatically sequence.

A typical sequence for bonding a wire to a terminal may go as follows: the tip descends onto the stripped section of wire and applies a compressive force between it and the anvil (compressing the stripped section of wire onto the base of the terminal), the location of the tip relative to the anvil is sensed, and if within tolerances, the transducer is actuated so as to apply ultrasonic vibration to the tip for a preset time. Finally, the tip is retracted away from the stripped section of wire. The result is a bond of the stripped section of wire relative to the top surface of the base of the terminal in an area defined generally by the tip area.

While ultrasonic welding methodologies have advanced considerably in recent years. One advance is applying ultrasonic welding processes to insulation jacketed wires without firstly stripping them. A preferred acronym therefor is "UWTI" (Ultrasonic Welding Through Insulation).

As described in U.S. patent application Ser. No. 09/993,797, filed Nov. 24, 2001, and commonly owned by the assignee of the present application, the disclosure of which is hereby incorporated herein by reference, an insulation jacketed wire (multi-strand or single strand) with its insulation jacket thereon and intact is placed upon a top surface of a base of a terminal to which it is to be bonded and the staking wings of the terminal are stacked down onto the insulation jacketed wire. The operator places the insulation jacketed wire and terminal into a conventional ultrasonic welder, such that the bottom surface of the base rests upon the anvil and the insulation jacketed wire is aligned with the tip. The operator then causes the sonic welder to automatically sequence to weld the wire to the terminal through the insulation of the wire. Considerations include, there must be a displacement volume for the melted insulation jacket to go to; the insulation jacket must be of a composition which melts when heated so that it will flowably displace, as for example thermoplastics; and the thinner the insulation jacket the better, particularly in terms of accommodating insulation jacket dissipation mass.

Examples of the method of UWTI were presented in the disclosure of application Ser. No. 09/993,797, as follows.

Three insulation jacketed wires were tested as indicated by Table I. Insulation jacketed wires having I.D. numbers 1 and 2 are a seven strand copper wire with an ultra thin wall PVC insulation jacket 0.25 mm thick. Insulation jacketed wire having I.D. number 3 is composed a solid core copper wire with an ultra thin wall PVC insulation jacket 0.25 mm thick. In each case the terminal was of a copper alloy. The ultrasonic welder was an "Ultraweld® 40" ultrasonic welder of AMTECH® (American Technology, Inc.) of Milford, Conn. operating at 40 kHz, having anvil and tip cross-sections of 2.1 mm by 2.1 mm. In each example an excellent ultrasonic bond was achieved between the wire and the terminal, in terms both of strength and electrical conductivity.

TABLE I

| I.D. No. | Wire Size ($mm^2$) | Energy (Joules) | 1st Contact Pressure (psi) | Weld Contact Pressure (psi) | Amplitude (microns) | Thickness Before Weld (mm) | Thickness After Weld (mm) |
|---|---|---|---|---|---|---|---|
| 1 | 0.35 (22 gauge) | 31 | 23 | 28 | 25 | 1.66 | 0.73 |
| 2 | 0.5 (20 gauge) | 34 | 30 | 33 | 27 | 1.80 | 1.00 |
| 3 | 0.14 (26 gauge) | 13 | 18 | 21 | 20 | 1.42 | 0.81 |

Advantages of the UWTI technology include improved electrical stability between the wire and the terminal, ability to construct multiple wiring subassemblies of complex wiring assemblies, and ability to utilize small gauge wires (smaller than 26 gauge, as for example 22 gauge and smaller) because the delicate wires are not subject to a stripping step which tends to damage them.

What remains needed in the art is to somehow incorporate UWTI technology into an electrical connector.

SUMMARY OF THE INVENTION

The present invention is an electrical connector utilizing a plurality of terminals to which wires have been ultrasonically welded, most preferably via UWTI technology, wherein the terminals are aligned for the welding process and also aligned in the connector via one or more terminal carriers.

The electrical connector includes a connector body featuring a central cavity communicating with adjoining side and rear openings of the connector body. A slide is slidably interfaced with the connector body for selectively closing the side opening. Each terminal is characterized by a blade and integral stem, wherein the blade provides an electrical contact with a corresponding terminal of an electrical connector configured for mating with the electrical connector according to the present invention, and the stem provides an ultrasonic welder wire weld surface and a wire stake down. Each terminal carrier (there may be more or less than two) is generally of a planar shape having a relatively thin thickness as compared to its area. The area is defined by a carrier body having a plurality of integrally formed terminal seats, each terminal seat being defined by a blade receptacle, a blade position assurance feature, and a vestibule. Each vestibule has an aperture through which an anvil of an ultrasonic welder passes during the ultrasonic welding process.

An operational scenario is as follows. The terminals are seated into their respective terminal seat, and then the wire or wires for each terminal are placed onto the stem of the respective terminal and then staked down. The ultrasonic welding (preferably UWTI) process is then implemented, wherein the anvil thereof passes through the aperture of the vestibule so that it is able to sonically and pressurably co-act with the tip of the ultrasonic welding apparatus to thereby effect an ultrasonic weld of the wire(s) to the respective terminals, preferably through the insulation thereof.

Next, the terminal carrier is slid into the side opening of the electrical connector such that the wires project out from the connector through the rear opening. The slide is then slid onto the connector to thereby close-off the side opening and trap the terminal carrier in the connector. In a preferred variant, two terminal carriers are utilized in superposed relation to each other.

Accordingly, it is an object of the present invention to provide an electrical connector having a plurality of aligned terminals, wherein wires have been ultrasonically welded to the terminals, particularly ultrasonically welded through the insulation thereof.

This and additional objects, features and advantages of the present invention will become clearer from the following specification of a preferred embodiment.

DESCRIPTION OF THE PREFERRED EMBODIMENT

Figure 1:
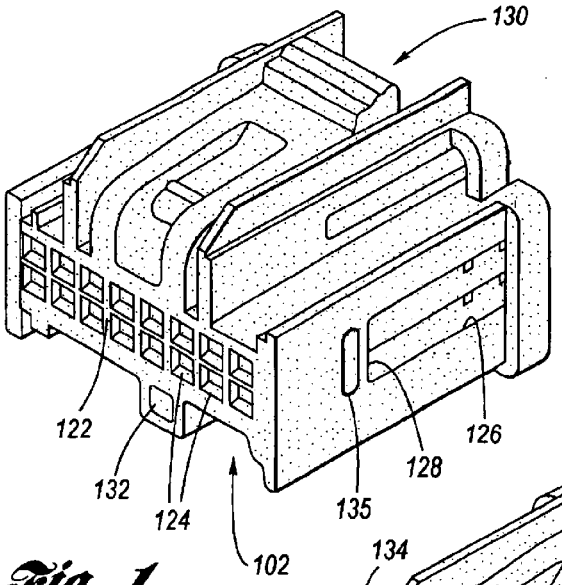
FIG. 1 is a perspective view of an electrical connector according to the present invention.
Figure 2:
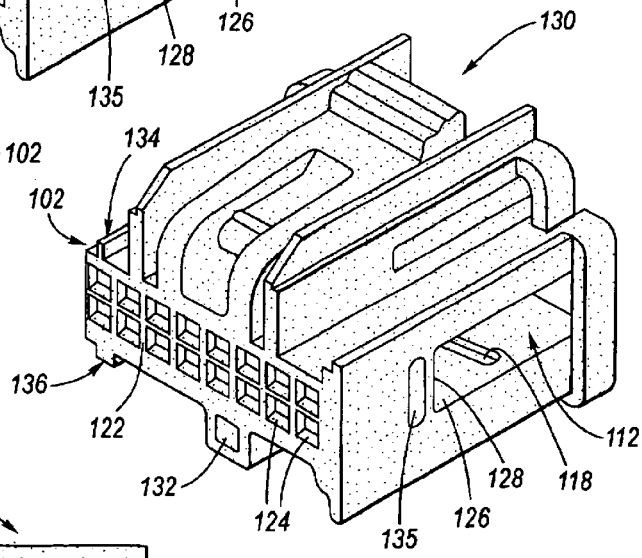
FIG. 2 is a perspective view of a connector body of the electrical connector of FIG. 1.
Figure 3:
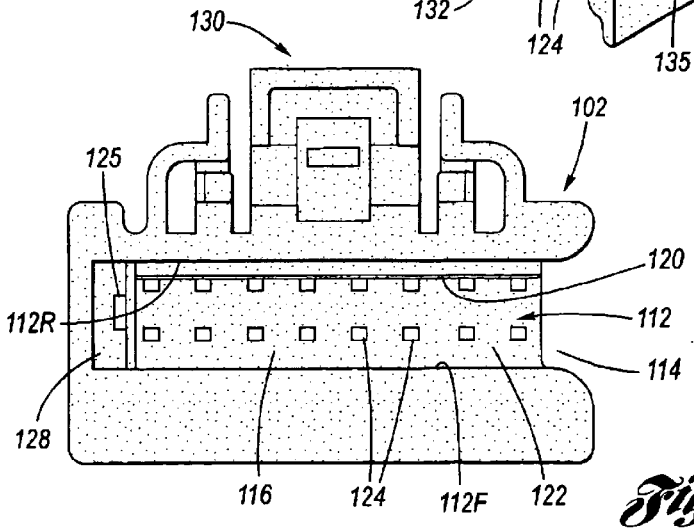
FIG. 3 is a rear end elevational view of the connector body of FIG. 2.
Figure 4:
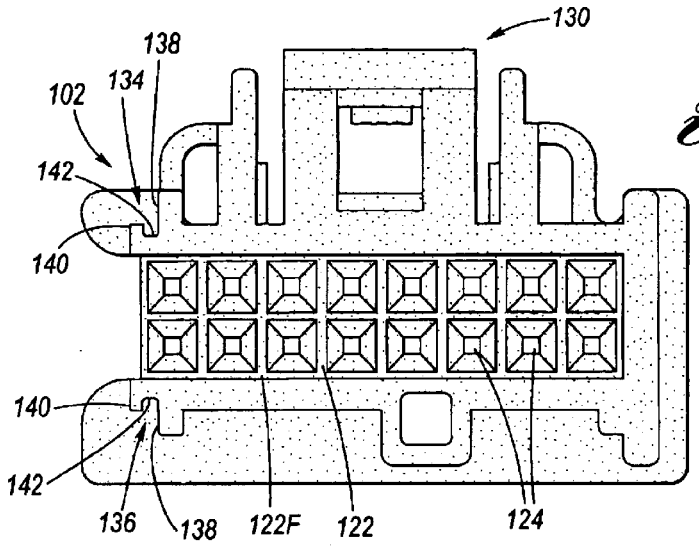
FIG. 4 is a forward end elevational view of the connector body of FIG. 2.
Figure 6:
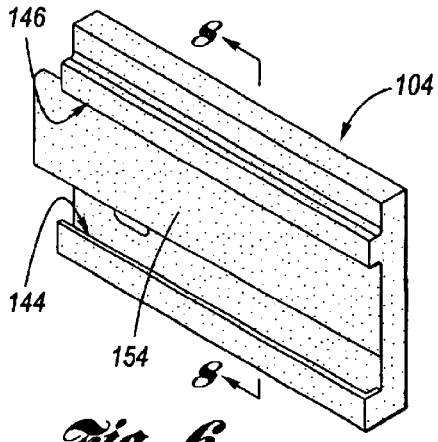
FIG. 6 is a perspective view of a slide according to the present invention for slidably interfacing with the connector body of FIG. 2.
Figure 5:
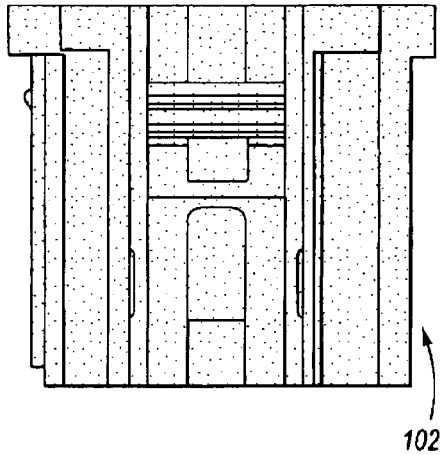
FIG. 5 is a top elevational view of the connector body of FIG. 2.
Figure 7:
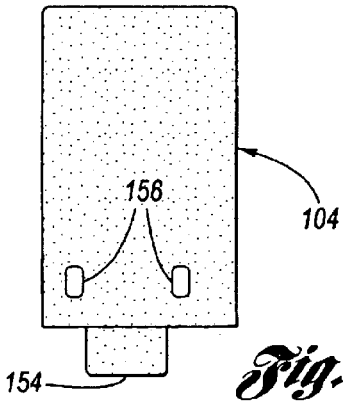
FIG. 7 is a side view of the slide of FIG. 6.
Figure 8:
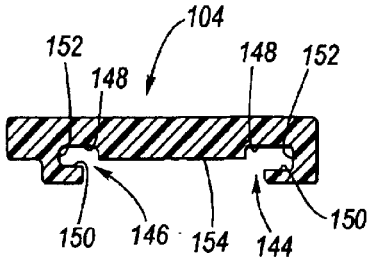
FIG. 8 is a sectional view of the slide, seen along line 8—8 of FIG. 6.

Referring now to the Drawing, FIG. 1 depicts an electrical connector 100 according to the present invention. The electrical connector 100 includes a connector body 102, a slide 104, and a pair of terminal carriers 106*a*, 106*b*. The electrical connector 100, further includes a plurality of terminals 108 (see FIG. 17) which are seated in respective terminal seats 110 of the terminal carriers (see FIG. 18).

The connector body 102 is preferably composed of a plastic material and has a central cavity 112 which communicates with mutually adjoining and mutually communicating side and rear openings 114, 116. The cavity floor 112F of the central cavity 112 has a transverse indexing slot 118 formed therein which extends to the side opening 114, and the cavity roof 112R of the central cavity has a transverse indexing boss 120 protruding therefrom. A front wall 122 has a plurality of pin holes 124 which are tapered at the front side 122F for receiving therethrough pin terminals 105 of an electrical connector 115 structured for mating with the electrical connector 100 (see FIG. 21). A side access port 126 is provided in the connector body 102 opposite the side opening 114. The port wall 128 of the access port 126 has a protruding detent 125, wherein a relief slot 135 is formed in the connector body adjacent the port wall to permit resilient flexing of the port wall with respect to operation of the detent (discussed hereinbelow). The connector body 102 has preferably additional features such as a resilient connector position assurance member 130 for interfacing with the mating electrical connector 115 and a guide surface 132 for guidably interfacing with a reciprocably shaped structure of the mating electrical connector.

At the side opening 114, the connector body has an upper connector body track 134 formed opposite the cavity roof 112R and has a lower connector body track 136 formed opposite the cavity floor 112F. The upper and lower connector body tracks 134, 136 include a guide rail 138, a lock rail 140 and a groove 142 formed therebetween, wherein the guide rails are protrudingly displaced relative to the front wall 122.

The slide 104 has a thin planar configuration. An upper slide track 144 is located at an upper edge of the slide 104, and a lower slide track 146 is formed at a lower edge of the slide. Each of the upper and lower slide tracks 144, 146 are characterized by a guide lip 148, a lock lip 150 and a slot 152 formed therebetween. A tongue 154 projects from a forward end 104F of the slide 104 and runs the length of the slide. Adjacent the forward end 104F is a pair of elongated holes 156, one on either side of the tongue 154.

Figure 9:
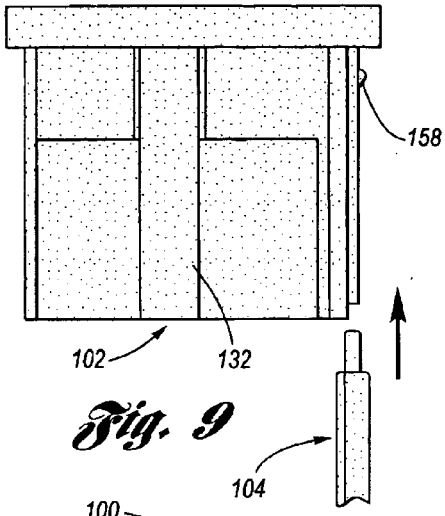
FIG. 9 is a bottom elevational view of the connector body of FIG. 2 about to be slidably interfaced with the side of FIG. 6.
Figure 11:
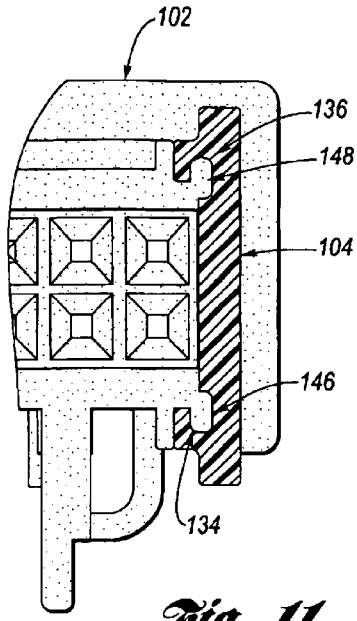
FIG. 11 is a broken-away, partly sectional view of the connector body, seen along line 11—11 of FIG. 10.
Figure 10:
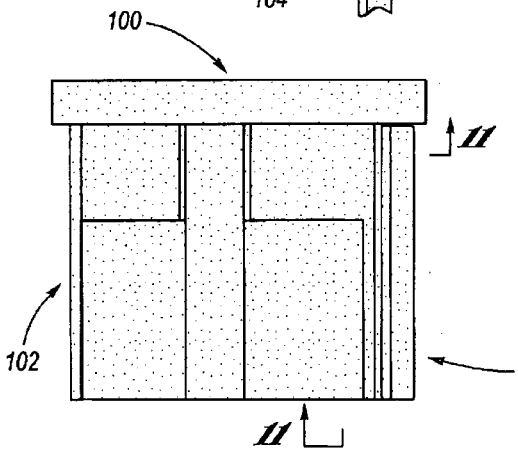
FIG. 10 is a bottom elevational view of the electrical connector of FIG. 1.

As shown at FIGS. 9 and 10, the slide 104 is slidably interfaced with the connector body 102 by the projection of the tongue 154 facing in the forward direction of travel and the upper and lower connector body tracks 134, 136 aligned with the upper and lower slide tracks 144, 146. As the slide is slid relative to the connector body, the lock rail 140 slides in the slot 152 and the lock lip 150 slides in the groove 142, wherein the guide rail 138 guides the guide lip 148 and the lock lip 150 is interferingly trapped by the lock rail 140, and wherein the tongue 154 is located between the cavity roof 112R and cavity floor 112F. A pair of nibs 158 on the lock rails 140 snappingly enter the pair of elongated holes 156 of the slide 104 so as to thereby affix the slide to the connector body 102 at the fully slid position (positively defined by blind ends of the slots 152 and abutment of the slide with the rear end of the connector body).

Figure 12:
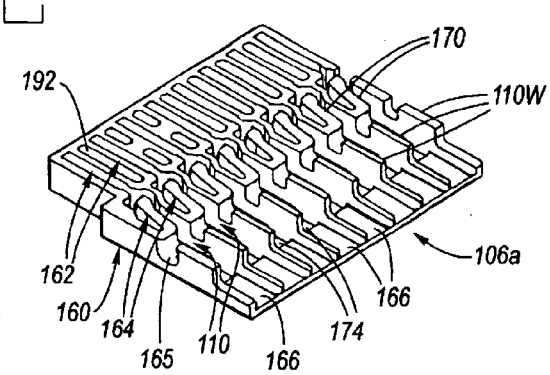
FIG. 12 is a perspective view of a terminal carrier according to the present invention.
Figure 13:
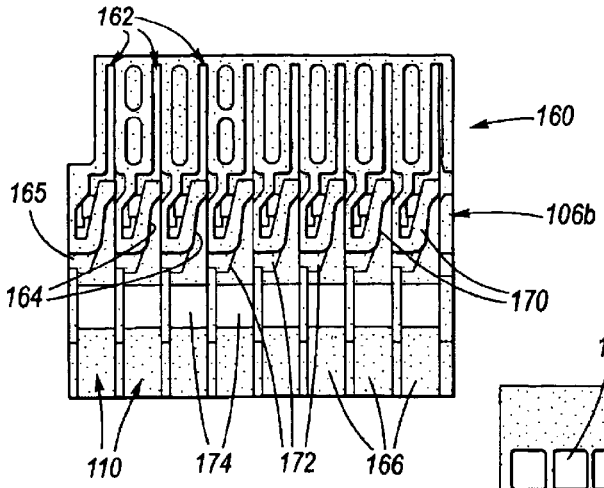
FIG. 13 is a top elevational view of the terminal carrier of FIG. 12.
Figure 14:
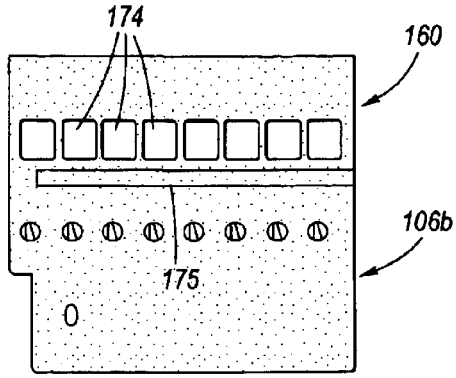
FIG. 14 is a bottom elevational view of the terminal carrier of FIG. 12.
Figure 15:
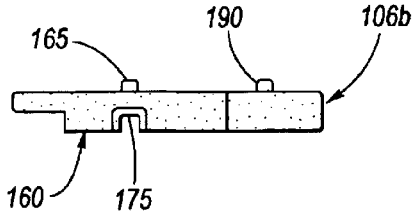
FIG. 15 is a side elevational view of the terminal carrier of FIG. 12.
Figure 16:
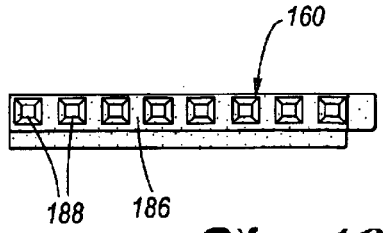
FIG. 16 is an end elevational view of the terminal carrier of FIG. 12.

Turning attention now to the terminal carriers 106*a*, 106*b*, as shown at FIGS. 12, 13 and 16, each has a generally a planar shape having a relatively thin thickness as compared to its area. The area is defined by a carrier body 160 upon which are integrally formed a plurality of (above mentioned) terminal seats 110, defined by separation walls 110W. Each terminal seat 110 is defined by a blade receptacle 162, a blade position assurance feature 164, and a vestibule 166 which is in a common plane of a seat floor 168 that extends into the blade receptacle. The blade position assurance feature 164 is composed of a resilient arm 170 which is connected to a ledge 172. Both the arm and the ledge are elevated above (that is, spaced from) the seat floor 168. Each vestibule 166 has an aperture 174. A transverse indexing carrier boss 165 is located at the bottom side of the terminal carriers 106*a*, 106*b*, and a transverse indexing carrier slot 175 is located at the ledge 172 and is formed of the separation walls 110W.

Figure 17:
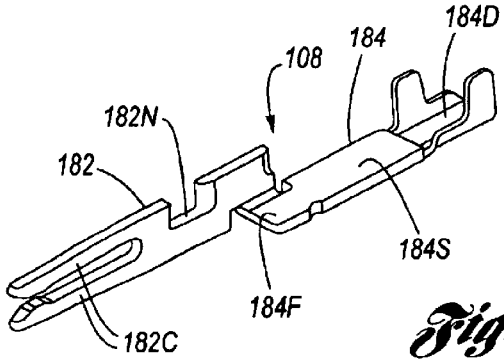
FIG. 17 is a perspective view of a terminal according to the present invention.
Figure 18:
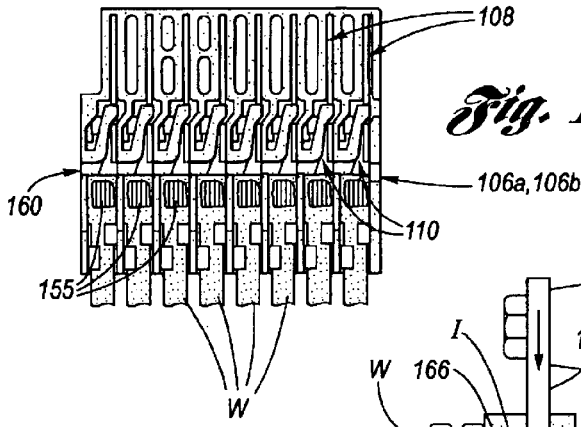
FIG. 18 is a top elevational view of the terminal carrier of FIG. 12, shown in operation with respect to a plurality of terminals and their respectively associated wires.

The terminal 108 which seats respectively in each of the terminal seats 110 is shown at FIG. 17, and includes a blade 182 and an integral stem 184, wherein the blade provides an electrical contact with a corresponding pin terminal 105 of a mating electrical connector 115 (see FIG. 21), and the stem provides an ultrasonic welder wire weld surface 184S and a wire stake down 184D. The blade 182 has a pair of spaced apart contacts 182C between which the corresponding pin terminal is inserted in operation. A notch 182N is formed in the blade rearwardly of the contacts 182C.

With simultaneous reference to FIGS. 12 through 18, the seating of the terminals 108 with respect to the terminal carrier 106*a*, 106*b* will be described. A terminal 108 is placed initially into a terminal seat 110 with the blade 182 just entering a blade receptacle 162 (which is narrow and snuggly receives the blade at a perpendicular orientation to the seat floor 168) and with a forward portion 184F of the stem 184 resting flatly on the vestibule 166. Now the terminal 108 is thrust toward the front end 186 of the terminal carrier. The forward portion 184F of the stem goes snuggly under the ledge 172 and the arm 170 resiliently extends into and over the notch 182N, thereby locking the terminal into its terminal seat. The front end 186 of the carrier body 160 of each of the terminal carriers (see FIG. 16) has a tapered terminal opening 188, respectively, for each terminal seat so that a pin terminal 105 of the mating electrical connector 115 can insert through and thereby pass contactingly between the contacts 182C. Once inserted, a wire (or wires) is staked down onto the stem 184 of the terminal 108, wherein a low step of the separation wall 110W at the rear end portion of the vestibule 166 facilitates this process.

Figure 19:
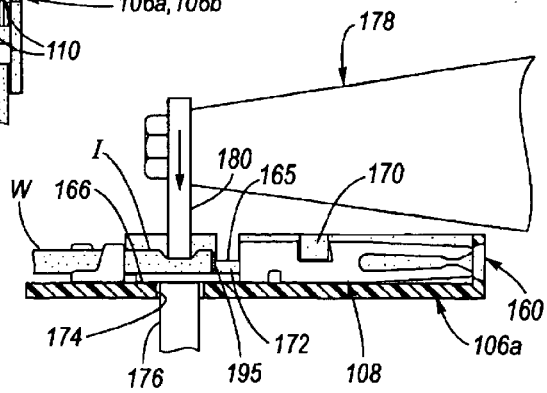
FIG. 19 is a broken-away, partly sectional schematic side view of a UTWI process with respect to the terminal carrier, terminals and wires as depicted at FIG. 18.

Now as shown at FIG. 19 an ultrasonic welding process is undertaken wherein the anvil 176 thereof passes through the aperture 174 of the vestibule 166 of the carrier body 160 so that it is able to sonically and pressurably co-act with the tip 180 of the ultrasonic welding apparatus 178 to thereby effect an ultrasonic weld 155 of the conductive 195 wire of the insulated wires W to the respective terminal 108. The ultrasonic welding may be conventional with the insulation stripped at the weld location, or, preferably, via the UWTI technology through the insulation I thereof.

Figure 20:
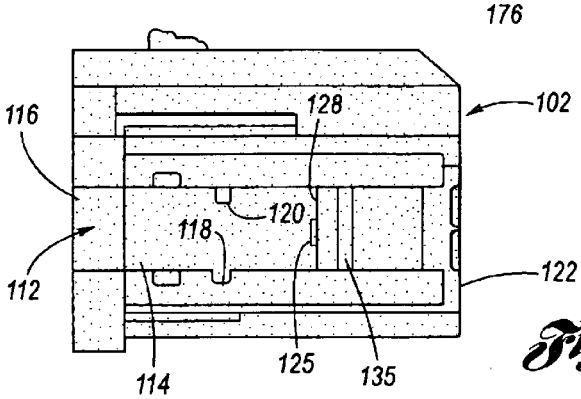
FIG. 20 is a side elevational view of the connector body of FIG. 2, showing particularly the side opening and communicating central cavity thereof.
Figure 21:
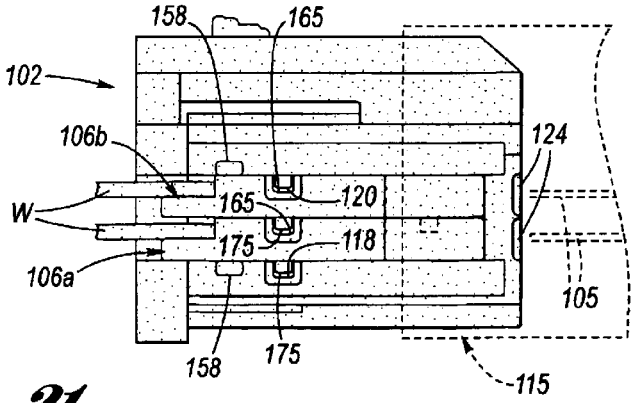
FIG. 21 is a side view as in FIG. 20, now showing a pair of mutually superposed terminal carriers located in the central cavity after having slid therein through the side opening.
Figure 22:
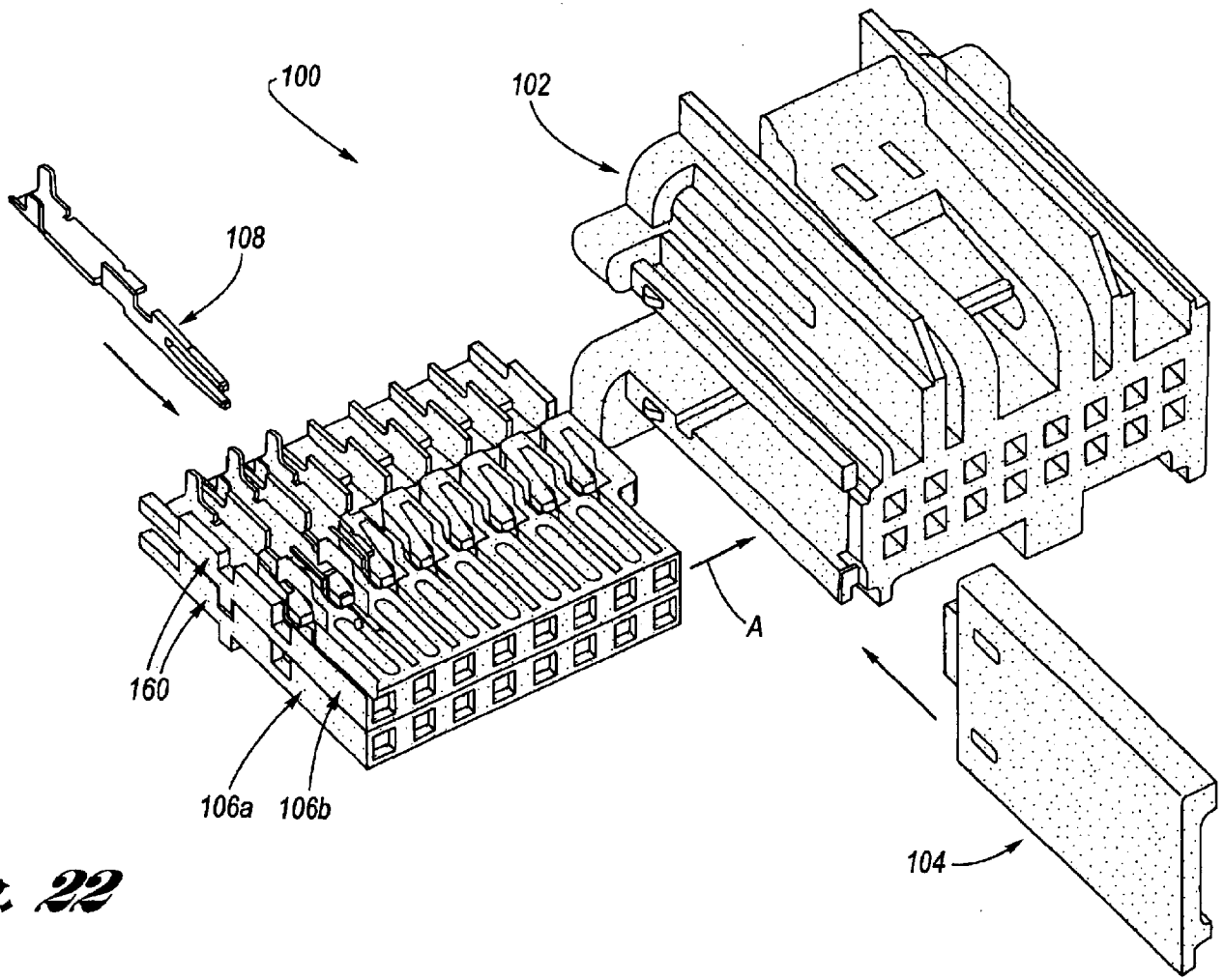
FIG. 22 is an exploded view of an electrical connector according to the present invention.

A difference between the two terminal carriers 106*a*, 106*b* is that terminal carrier 106*b* has a location boss 190 which, when the terminal carriers are superposed (see FIG. 22), extends into a relief slot 192 of terminal carrier 162*a* formed between the blade seats thereof. When superposed, indexing occurs by the carrier boss 165 of terminal carrier 160*b* inserts into the carrier slot 175 of terminal carrier 160*a*. With the terminal carriers 106*a*, 106*b* superposed, they are then inserted into the central cavity 126 through the side opening 114 (see FIG. 20) along arrow A (of FIG. 22) such that the insulated wires W are able to pass out through the rear opening 116, as shown at FIG. 21. In this regard, indexing occurs by the carrier boss 165 of terminal carrier 160*a* inserting into and sliding along the connector body slot 118, and the connector body boss 120 inserting into and sliding along connector body slot 175 of terminal carrier 106*b*. Upon completion of the insertion of the terminal carriers, the detent 125 snappingly holds them in place by engagement with a corresponding nib 194 (see FIGS. 13 and 14) of the terminal carriers. Now, each pin hole 124 aligns with a respective terminal opening 188. The slide 104 is now slid onto the connector body 102 as described hereinabove to thereby trap and locate the terminal carriers 106*a*, 106*b*, wherein a locating bump 196 on the terminal carriers abuts the slide, the end result of which yielding the electrical connector 100.

To disassemble the electrical connector 100, the slide 104 is slid off the connector body 102 and the terminal carriers 106*a*, 106*b* are slid out of the central cavity 112 via side opening 114 by pushing thereupon at the access port 126.

In summation, there are a number of advantages of the electrical connector 100 which, among many others, are worthy of note.

In general, automated and/or manual wiring harness sub-assemblies are made possible, wherein large complex harnesses can be broken down into simple sub-assemblies with a few manual plugs. Further, synchronous sub-assembly design and processing can be performed, which are adaptable to standard configurations of existing connections.

The utilization of UTWI technology allows for the assembly of wire harnesses with wire smaller than 22 gauge (ie., 26 gauge or even smaller), resulting in reduced bundle size, reduced mass, and reduced cost, and further eliminates wire stripping and the potential cut strands stripping produces. Also, connection to ultra-thin wall cable is possible.

With regard to the terminal carriers, the superposed stacking of the terminal carriers with integrated terminal position assurance, allows high density 2.54×2.54×N row terminal packaging. Further, large cable/center lines can be accommodated (up to 18 gauge wire on 2.54 terminal centers. And, the broad multiple gauge capability and 2.54 center line design covers 26 to 18 gauge ultra thin wall cable. The removability of the terminal carriers and the flexible arms of the terminal position assurance feature facilitates repair without damage. The terminal position assurance feature allows manual or automated plug and unplug.

With regard to the terminal, the thick stock tuning fork terminal blade configuration has lower bulk resistance than thinner stock 'formed' terminals commonly used. The 'blanked' contact with flats is more accurate and stable than 'formed' contacts commonly used, resulting in more consistent contact and pin terminal engagement force. The thin stock bypass insulation crimp provides for maximum range of wire gauge capability. The short progression of the terminal allows multiple terminals to be formed in a single die stroke, and the carrier-through-terminal body configuration reduces material usage and cost. The open contact design facilitates post-stamp plating. The central cavity and terminal carrier index features to prevent incorrect stacking and insertion of the terminal carriers.

To those skilled in the art to which this invention appertains, the above described preferred embodiment may be subject to change or modification. For example, while a pair of terminal carriers has been shown and described, the number of terminal carriers may be more or less than two, as for non-limiting example, four). Such change or modification can be carried out without departing from the scope of the invention, which is intended to be limited only by the scope of the appended claims.

What is claimed is:

1. An electrical connector comprising:

a connector body having a side opening, a rear opening communicating with said side opening and a central cavity communicating with said side and rear openings;

at least one terminal carrier, said terminal carrier comprising a carrier body defining a plurality of terminal seats; and indexing features located on said at least one terminal carrier and on said connector body at said central cavity, said indexing features mutually cooperating to guide removable placement of said at least one terminal carrier into said central cavity through said side opening;

wherein each said terminal seat comprises a blade receptacle, a vestibule, and a terminal position assurance feature located between said blade receptacle and said vestibule, said vestibule having an aperture formed therein.

2. The electrical connector of claim 1, wherein said at least one terminal carrier comprises two mutually superposed terminal carriers.

3. The electrical connector of claim 1, further comprising a slide slidably interfaced with said connector body at said side opening, said slide retaining said at least one terminal carrier in said central cavity.

4. The electrical connector of claim 3, further comprising a plurality of terminals, one terminal for each terminal seat, respectively, wherein each said terminal comprises a blade and a stem integrally connected with said blade; wherein when each said terminal is seated in its respective terminal seat, said blade is seated in said blade receptacle, said stem rests upon said vestibule and said terminal position assurance feature locks said terminal with respect to the terminal seat.

5. The electrical connector of claim 4, wherein said position assurance feature of each terminal seat comprises a ledge and a resilient arm both trapping the respective terminal seated thereat.

6. The electrical connector of claim 5, wherein said blade is oriented perpendicular in relation to said stem, wherein said blade comprises a pair of spaced apart contacts, and wherein said stem comprises a weld surface for ultrasonic welding of at least one wire and a wire stake down, and wherein when said terminal is seated in its terminal seat, said weld surface is; located in superposition with said aperture of said vestibule.

7. The electrical connector of claim 6, further comprising at least one wire ultrasonically welded to each said terminal at the weld surface thereof.

8. The electrical connector of claim 7, wherein said ultrasonic weld is an ultrasonic weld through insulation of the wire.

9. The electrical connector of claim 7, wherein said connector body has a front wall having a plurality of holes, and wherein said carrier body has a front end having a plurality of terminal openings, one opening respectively at each blade receptacle, wherein when said at least one terminal carrier is placed in said central cavity, a hole aligns respectively with each terminal opening.

10. The electrical connector of claim 9, wherein said at least one terminal carrier comprises two mutually superposed terminal carriers.

11. The electrical connector of claim 10, further comprising a slide slidably interfaced with said connector body at said side opening, said slide retaining said at least one terminal carrier in said central cavity.

12. The electrical connector of claim 11, wherein said ultrasonic weld is an ultrasonic weld through insulation of the wire.

13. An electrical connector comprising:

a connector body having a side opening, a rear opening communicating with said side opening and a central cavity communicating with said side and rear openings;

a pair of mutually superposed terminal carriers, each said terminal carrier comprising a carrier body defining a plurality of terminal seats;

indexing features located on said at least one terminal carrier and on said connector body at said central cavity, said indexing features mutually cooperating to guide removable placement of said at least one terminal carrier into said central cavity through said side opening;

a plurality of terminals, one terminal for each terminal seat, respectively, wherein each said terminal comprises a blade and a stem integrally connected with said blade;

a slide slidably interfaced with said connector body at said side opening, said slide retaining said at least one terminal carrier in said central cavity;

wherein each said terminal seat comprises a blade receptacle, a vestibule, and a terminal position assurance feature located between said blade receptacle and said vestibule, said vestibule having an aperture formed therein; and wherein when each said terminal is seated in its respective terminal seat, said blade is seated in said blade receptacle, said stem rests upon said vestibule and said terminal position assurance feature locks said terminal with respect to the terminal seat.

14. The electrical connector of claim 13, wherein said blade is oriented perpendicular in relation to said stem, wherein said blade comprises a pair of spaced apart contacts, and wherein said stem comprises a weld surface for ultrasonic welding of at least one wire and a wire stake down, and wherein when said terminal is seated in its terminal seat, said weld surface is located in superposition with said aperture of said vestibule.

15. The electrical connector of claim 14, wherein said position assurance feature of each terminal seat comprises a ledge and a resilient arm both trapping the respective terminal seated thereat, and wherein said connector body has a front wall having a plurality of holes, and wherein said carrier body has a front end having a plurality of terminal openings, one opening respectively at each blade receptacle, wherein when said at least one terminal carrier is placed in said central cavity, a hole aligns respectively with each terminal opening.

16. The electrical connector of claim 15, further comprising at least one wire ultrasonically welded to each said terminal at the weld surface thereof.

17. The electrical connector of claim 16, wherein said ultrasonic weld is an ultrasonic weld through insulation of the wire.

18. A method for forming an electrical connector, comprising the steps of:

providing a terminal carrier having a plurality of terminal seats, wherein each terminal seat comprises a blade receptacle, a vestibule, and a terminal position assurance feature located between said blade receptacle and said vestibule, said vestibule having an aperture formed therein;

said terminal carrier further comprising indexing features configured to cooperate with complementary indexing features located on a central cavity of a connector body to guide removable placement of said terminal carrier into said central cavity;

seating a terminal into a terminal seat, wherein the terminal position assurance feature locks the terminal in the seat such that a stem of the terminal is in superposition with said aperture;

ultrasonically welding the wire to the stem by an anvil of an ultrasonic welding apparatus passing through said aperture; and installing the terminal carrier into an electrical connector body to thereby form an electrical connector.

19. The method of claim 18, wherein said step of ultrasonically welding comprises ultrasonically welding through insulation of the wire.

* * * * *